US005109950A

United States Patent [19]

Lescher

[11] Patent Number: 5,109,950

[45] Date of Patent: May 5, 1992

[54] SILENCER FOR EXHAUST GASES AND PART OF AN EXHAUST LINE HAVING SUCH A SILENCER

[75] Inventor: Henri Lescher, Saint Germain en Laye, France

[73] Assignee: Glaenzer Spicer, Poissy, France

[21] Appl. No.: 471,611

[22] Filed: Jan. 29, 1990

[30] Foreign Application Priority Data

Jan. 27, 1989 [FR] France ..... 89 01064

[51] Int. Cl.[5] ..... F01N 1/10

[52] U.S. Cl. ..... 181/256; 181/265; 181/280

[58] Field of Search ..... 181/252, 255, 256, 279, 181/280, 265

[56] References Cited

U.S. PATENT DOCUMENTS

| | | | |
|---|---|---|---|
| 1,909,394 | 5/1933 | Dodge | 181/249 |
| 2,523,260 | 9/1950 | Campbell . | |
| 2,613,758 | 10/1952 | Cullum . | |
| 2,640,557 | 6/1953 | Gaffney | 181/265 X |
| 2,646,854 | 7/1953 | Walker . | |
| 2,911,055 | 11/1959 | McDonald . | |
| 2,913,870 | 11/1959 | Lashley . | |
| 2,990,906 | 7/1961 | Audette . | |
| 3,119,459 | 1/1964 | Ludlow et al. . | |
| 3,147,097 | 9/1964 | Agues | 181/258 X |
| 3,292,731 | 12/1966 | Ballard . | |
| 3,580,357 | 5/1971 | Whitney . | |
| 3,710,891 | 1/1973 | Flugger . | |
| 3,732,948 | 5/1973 | Benton et al. . | |
| 3,746,126 | 7/1973 | De Cardenas . | |
| 3,901,350 | 8/1975 | Loffelhardt . | |
| 4,263,982 | 4/1981 | Feuling . | |
| 4,530,418 | 7/1985 | Currie . | |
| 4,667,770 | 5/1987 | DeVane | 181/280 |
| 4,685,534 | 8/1987 | Burstein et al. | 181/280 X |
| 4,712,643 | 12/1987 | Iles et al. | 181/258 X |

FOREIGN PATENT DOCUMENTS

| | | | |
|---|---|---|---|
| 1954319 | 5/1971 | Fed. Rep. of Germany . | |
| 1129207 | 7/1955 | France . | |
| 1226438 | 10/1958 | France . | |
| 1301056 | 8/1961 | France . | |
| 2282533 | 3/1976 | France . | |
| 2589195 | 4/1987 | France . | |
| 315617 | 3/1934 | Italy | 181/258 |
| 497779 | 9/1954 | Italy . | |
| 500541 | 11/1954 | Italy | 181/280 |
| 319626 | 9/1929 | United Kingdom . | |

*Primary Examiner*—Benjamin R. Fuller
*Assistant Examiner*—Victor DeVito
*Attorney, Agent, or Firm*—Wenderoth, Lind & Ponack

[57] ABSTRACT

A silencer is provided for reducing noise from exhaust gases from an internal combustion engine. The silencer is of the type having an outer cylindrical cover and a coaxial inner cylindrical tube which define between them an annular cylindrical chamber into which the exhaust gases which enter the silencer are admitted. The inner tube is a perforated tube, a first open end of which forms the sole admission orifice for the gases into the silencer and the other opposite end of which is closed. The inside wall of the outer cover is lined with a layer of absorbent material mounted about the inner tube along substantially the entire perforated length of the inner tube.

13 Claims, 1 Drawing Sheet

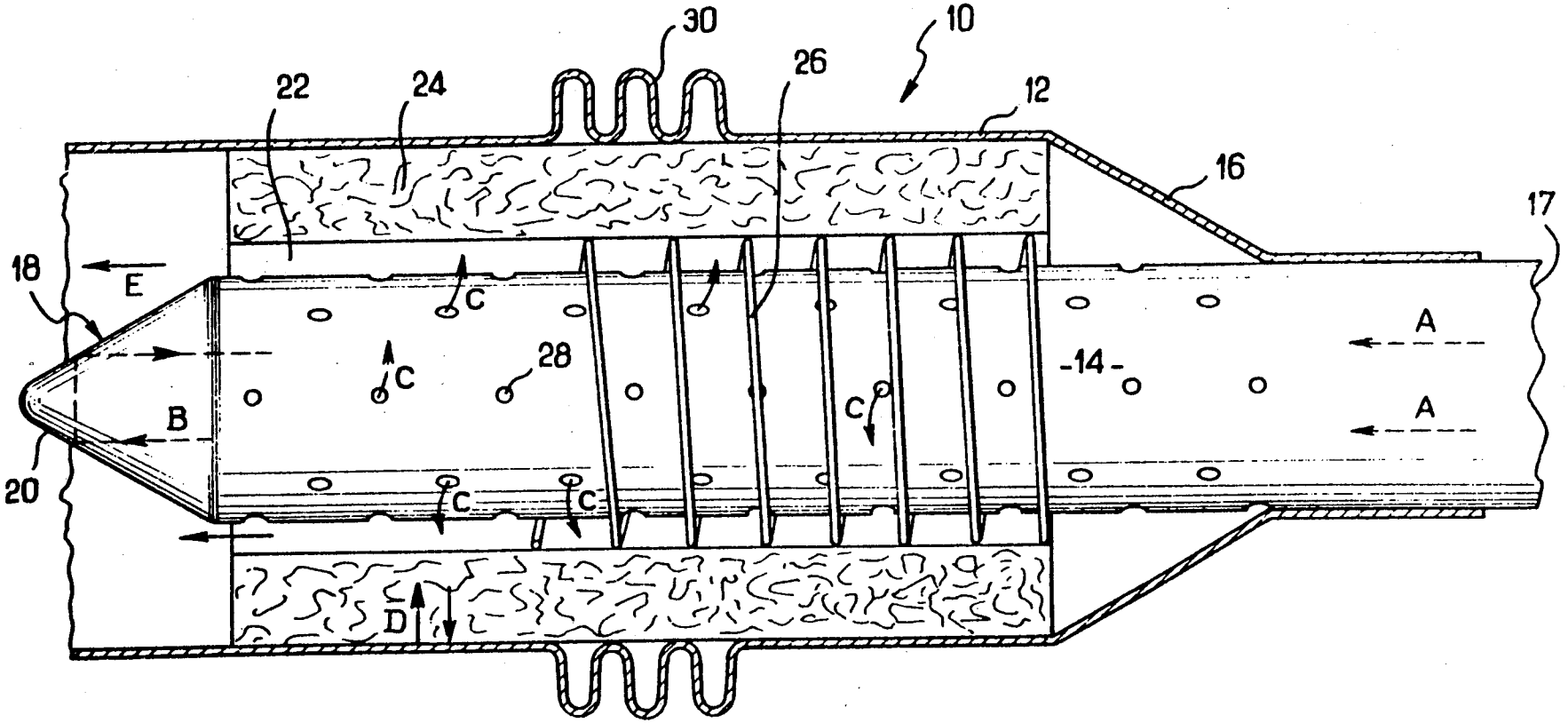
17
A
A
16
-14-
12
10
C
26
30
28
C
C
C
C
24
D
22
B
E
18
20

SILENCER FOR EXHAUST GASES AND PART OF AN EXHAUST LINE HAVING SUCH A SILENCER

BACKGROUND OF THE INVENTION

The present invention relates to a silencer for exhaust gases from an internal combustion engine of the type having an outer cylindrical cover and a coaxial inner cylindrical tube which define between them an annular cylindrical chamber into which the exhaust gases which enter the silencer are admitted.

The invention also relates to a part of an exhaust line incorporating such a silencer.

The higher temperature of the exhaust gases generally has the disadvantage of causing the constituent materials, and in particular the metals, of the silencers to experience fatigue in a relatively short time such that they are often used beyond the period in which they perform properly.

These high temperatures create total or partial deformation and/or destruction in the exhaust lines, especially in the inlet zone of the silencers, in particular because of a thermal fatigue phenomenon. This phenomenon takes on more and more importance with the widespread use of exhaust lines having catalytic pollution-control units, at the outlet of which the gases commonly reach temperatures greater than 900° C. Furthermore, very high temperatures are not conducive to the use of light alloys, the low density of which would otherwise enable very substantial reductions in weight.

Furthermore, low-frequency vibrations, created by the succession of explosions at certain engine speeds and by the mechanical excitation of certain elements such as the engine-silencer connecting tubes, as well as the transverse partitions of the silencer against which the exhaust gases collide, are a considerable annoyance and cause a dull noise in the passenger compartment of the vehicle.

SUMMARY OF THE INVENTION

The object of the present invention is to provide a silencer which enables the temperature peaks to which the constituent materials of the silencer are subjected to be reduced and distributed and the majority of the low frequencies normally created in a silencer to be converted simultaneously into medium and high frequencies which are easier to dampen and to absorb. The invention must also enable the impact of the shock waves caused by the gases impinging against the walls or bases, which are perpendicular to the direction of propagation of the gases and the gas jets, to be suppressed by distributing them over a more substantial surface area.

To this end, the invention provides a silencer, characterized in that the inner tube is a perforated tube, a first open end of which forms the sole admission orifice for gases into the silencer and the other opposite end of which is closed, and in that the inside wall of the outer cover is coated with a layer of absorbent material which runs axially over substantially the entire length of the inner tube.

According to another feature, the closed end of the inner tube is shaped in order to cause the gases to be reflected.

The invention also provides a part of an exhaust line for the flow of the exhaust gases from an internal combustion engine. The part of the exhaust line is the type having a continuous outside cover with a substantially constant section enclosing at least one noise-reducing block positioned longitudinally in the cover so as to define at least one section for the transfer of the fluid. The part of the exhaust line has a given length so that this section participates in the noise-reduction function of the part of the exhaust line, characterized in that at least one section of the part of the exhaust line is produced so as to form a silencer according to the invention, for which the continuous outside cover has a substantially constant section forming the outer cylindrical cover of the silencer.

The section forming the silencer may, for example, be the inlet section of the exhaust line which has a joining portion connecting the inside wall of the outside cover to the open end of the inner tube.

BRIEF DESCRIPTION OF THE DRAWING FIGURE

Other features of the invention will emerge upon reading the description which follows, for the elucidation of which reference will be made to the attached drawing in which the single figure shows a silencer produced according to the teaching of the invention.

DETAILED DESCRIPTION OF THE INVENTION

The partial cross-sectional view of the figure shows a silencer 10 which has a cylindrical outer cover 12 connected to a cylindrical inner tube 14 for the admission of exhaust gases by a conical joining portion 16.

The inner cylindrical tube 14 has a first open end 17 through which are admitted all the exhaust gases circulating in a part of the exhaust line (not shown) by virtue of the joining portion 16 which guides all the gases towards this open end.

The second end 18 of the inner tube 14 is an end closed by a solid (i.e. non-perforated) end-wall 20 against which are reflected at least some B of the gases A which enter the inner tube 14. Any shape for the end 18, for example a body of revolution, which does not have a wall perpendicular to the flow and which causes the gases to be reflected may be suitable to close the tube. That is, the end wall of the inner tube is angled obliquely relative to the tube wall of the inner tube.

Along its entire length which is situated opposite the wall of the outer cylindrical cover 12, the wall of the inner tube is perforated so as to allow the admission of the gases C into the annular, cylindrical inside chamber 22 defined radially by the outside wall of the inner tube 14 and by the inside wall of the outer cover 12.

Along its entire length which faces the inner tube 14, the inside wall of the outer cover 12 is lined with an annular sleeve of an absorbent material 24. The absorbent material may, for example, be a layer of steel wool pressed radially outwardly by a helical spring 26.

The gases C which leave the inner tube 14 through the perforations 28 penetrate and may traverse the absorbent material 24 to impinge against and reflect from the inside wall of the outer cover 12 (as shown by arrow D).

The coefficient of thermal transmittivity of the constituent material, for example, aluminium, of the outer cover 12 is selected so as to be markedly greater than the coefficient of the absorbent material 25 so as to create a substantial temperature gradient, the thermal shock being received by the absorbent material 24.

Furthermore, the perforated inner tube 14 is sufficiently long to enable the heat flow to be absorbed and distributed over a considerable, rather than localized, cylindrical surface area.

The inner tube 14 is also sufficiently long so as to not create a counterpressure detrimental to the general flow of the gases in the exhaust line.

It can be seen that the shock wave at no time meets a perpendicular wall in the general direction of its propagation.

During their passage through the holes 28 of the perforated tube 14, the low frequencies are converted into medium and high frequencies by a phenomenon known as "whistle".

The absorbent material 24 also participates in the noise-reduction function by absorbing a large number of these medium and high frequencies.

Because of the substantially larger diameter of the outer cover 12 relative to the inner tube 14 in their zones which jointly define the annular chamber 22, a slowing down of the speed of propagation of the exhaust gases results, thereby reducing the amount of noise generated. The diameter of the outer cover is, for example, 2 to 5 times greater than that of the inner tube.

The reflection of the gases which leave the absorbent material causes them to lose some of their calories, the latter being drawn out progressively towards the outside to reach the cover 12 which forms the exchange medium with the outer air. The final exchange surface area may be increased by providing a ringed zone 30 which projects radially outwardly.

Lastly, the passage of the gases through the holes 28 enables homogenization of the gases to be achieved, and also provides for a better combustion of the non-burned residues.

I claim:

1. A silencer for exhaust gases from an internal combustion engine, comprising:

an outer cylinder cover;

a single inner cylinder tube mounted coaxially within said outer cylinder cover to form an annular chamber between said inner cylinder tube and said outer cylindrical cover, said inner cylindrical tube being formed with a plurality of perforations therein and having a first open end for admission of the exhaust gases therethrough and a second closed end opposite said first open end, said second closed end comprising means for reflecting the exhaust gases as the exhaust gases impinge thereagainst;

a layer of absorbent material mounted about said inner cylindrical tube longitudinally along a substantial portion thereof;

wherein said annular chamber defines a means to allow the exhaust gases to flow substantially unhindered from said perforations formed in said inner tube to said layer of absorbent material; and wherein said layer of absorbent material defines a means for absorbing noise from the exhaust gases as the exhaust gases pass therethrough.

2. A silencer as recited in claim 1, wherein said inner cylindrical tube comprises a cylindrical tube wall; and said means for reflecting the exhaust gases comprises an end wall shaped so as to reflect the exhaust gases.

3. A silencer as recited in claim 2, wherein said end wall is shaped as a body of revolution.

4. A silencer as recited in claim 2, wherein said end wall comprises portions angled obliquely relative to said tube wall of said inner cylindrical tube.

5. A silencer as recited in claim 2, wherein said end wall of said closed end of said inner cylindrical tube is non-perforated.

6. A silencer as recited in claim 1, wherein said outer cover is formed of a material having a coefficient of thermal transmittivity which is greater than that of said layer of absorbent material.

7. A silencer as recited in claim 1, wherein said outer cover includes a ringed zone formed by outwardly protruding sections of said outer cover.

8. A silencer as recited in claim 1, wherein said outer cover is 2 to 5 times greater in diameter than said inner cylinder tube.

9. A silencer as recited in claim 1, wherein said perforations formed in said inner cylindrical tube are formed along substantially an entire length thereof from said first open end to said reflecting means of said closed second end.

10. A silencer as recited in claim 1, wherein said absorbent material is mounted directly against said outer cylindrical cover, such that said means, defined by said annular chamber, for allowing the exhaust gases to flow substantially unhindered from said perforations to said absorbent material is further operable to allow the exhaust gases to flow substantially unhindered from said absorbent material to impinge against and reflect from said cylindrical outer cover.

11. A part of an exhaust line for flow of exhaust gases from an internal combustion engine comprising:

a continuous outer cover having a substantially constant transverse cross-section; and a silencer including an outer cylindrical cover, a single inner cylindrical tube mounted coaxially within said outer cylindrical cover to form an annular chamber between said inner cylindrical tube and said outer cylindrical cover, said inner cylindrical tube being formed with a plurality of perforations therein and having a first open end for admission of the exhaust gases therethrough and a second closed end opposite said first open end, said second closed end comprising means for reflecting the exhaust gases as the exhaust gases impinge thereagainst, a layer of absorbent material mounted about said inner cylindrical tube longitudinally along a substantial portion thereof, wherein said annular chamber defines a means to allow the exhaust gases to flow substantially unhindered from said perforations formed in said inner tube to said layer of absorbent material, wherein said layer of absorbent material defines a means for absorbing noise from the exhaust gases as the exhaust gases pass therethrough, wherein said continuous outer cover defines said outer cylindrical cover of said silencer.

12. A part of an exhaust line as recited in claim 11, wherein said silencer is disposed in an inlet section of the exhaust line.

13. A part of an exhaust line as recited in claim 11, wherein said silencer comprises a joining portion connecting said outer cover with said inner cylindrical tube.

* * * * *